US011035197B2

(12) United States Patent
Saeed

(10) Patent No.: US 11,035,197 B2
(45) Date of Patent: Jun. 15, 2021

(54) ANCHORING EXTRUSION LIMITER FOR NON-RETRIEVABLE PACKERS AND COMPOSITE FRAC PLUG INCORPORATING SAME

(71) Applicant: Exacta-Frac Energy Services, Inc., Conroe, TX (US)

(72) Inventor: Ahmed Mohamed Saeed, Cypress, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 45 days.

(21) Appl. No.: 16/580,108

(22) Filed: Sep. 24, 2019

(65) Prior Publication Data

US 2021/0087902 A1 Mar. 25, 2021

(51) Int. Cl.
*E21B 33/129* (2006.01)
*E21B 33/12* (2006.01)

(52) U.S. Cl.
CPC ..... *E21B 33/129* (2013.01); *E21B 33/1208* (2013.01)

(58) Field of Classification Search
CPC .. E21B 33/129; E21B 33/1208; E21B 33/134; E21B 33/12; E21B 33/1216; E21B 33/1204; E21B 33/13
See application file for complete search history.

(56) References Cited

U.S. PATENT DOCUMENTS

| | | | | |
|---|---|---|---|---|
| 3,587,736 | A | 6/1971 | Brown | |
| 6,598,672 | B2 * | 7/2003 | Bell | E21B 33/1216 166/118 |
| 7,214,831 | B2 | 5/2007 | Lan-Hargest et al. | |
| 8,047,279 | B2 | 11/2011 | Barlow et al. | |
| 8,113,276 | B2 | 2/2012 | Greenlee et al. | |
| 8,567,492 | B2 | 10/2013 | White | |
| 8,955,605 | B2 | 2/2015 | VanLue | |
| 8,997,853 | B2 | 4/2015 | VanLue | |
| 9,010,411 | B1 | 4/2015 | VanLue | |
| 9,074,439 | B2 | 6/2015 | VanLue | |
| 9,157,288 | B2 | 10/2015 | Martinez | |
| 9,316,806 | B2 | 4/2016 | VanLue | |
| 9,334,703 | B2 | 5/2016 | VanLue | |
| 9,416,617 | B2 | 8/2016 | Wiese et al. | |
| 9,631,453 | B2 | 4/2017 | VanLue | |
| 9,677,356 | B2 | 6/2017 | Rochen | |
| 9,719,320 | B2 | 8/2017 | VanLue | |
| 9,725,918 | B2 | 8/2017 | Young et al. | |
| 9,725,982 | B2 | 8/2017 | VanLue | |
| 9,698,228 | B2 | 9/2017 | VanLue | |
| 9,759,029 | B2 | 9/2017 | Davies et al. | |
| 9,845,656 | B2 | 12/2017 | Zimmerman et al. | |
| 10,294,749 | B2 | 5/2019 | Rocher | |
| 10,704,355 | B2 * | 7/2020 | Deng | F16J 15/028 |
| 2009/0255690 | A1 | 10/2009 | Conner et al. | |

(Continued)

*Primary Examiner* — Michael R Wills, III
(74) *Attorney, Agent, or Firm* — J. Bennett Mullinax, LLC

(57) ABSTRACT

An anchoring extrusion limiter for a non-retrievable packer has a plurality of ring segments with a top surface having at least one ring segment insert designed to bite and grip a well casing in which a packer is set. The anchoring extrusion limiter inhibits an extrusion of a main sealing element of the packer while providing anchoring backup to the anchoring slips of the packer.

18 Claims, 4 Drawing Sheets

(56) References Cited

U.S. PATENT DOCUMENTS

| | | | | |
|---|---|---|---|---|
| 2010/0006280 | A1* | 1/2010 | Porter | E21B 33/129 166/134 |
| 2011/0079383 | A1* | 4/2011 | Porter | E21B 33/1277 166/118 |
| 2012/0073834 | A1* | 3/2012 | Lembcke | E21B 33/129 166/387 |
| 2012/0097384 | A1 | 4/2012 | Valencia et al. | |
| 2013/0192853 | A1* | 8/2013 | Themig | E21B 33/1216 166/387 |
| 2015/0152709 | A1* | 6/2015 | Tough | E21B 43/26 166/374 |
| 2016/0097253 | A1 | 4/2016 | Ruffo et al. | |
| 2016/0123100 | A1* | 5/2016 | Tse | E21B 33/1216 166/387 |
| 2016/0298403 | A1* | 10/2016 | Davis | E21B 33/129 |
| 2017/0107783 | A1* | 4/2017 | Wakefield | E21B 33/1216 |
| 2019/0292874 | A1* | 9/2019 | Saeed | E21B 23/01 |

* cited by examiner

ANCHORING EXTRUSION LIMITER FOR NON-RETRIEVABLE PACKERS AND COMPOSITE FRAC PLUG INCORPORATING SAME

FIELD OF THE INVENTION

This invention relates in general to anti-extrusion limiters for non-retrievable packers, commonly called "frac plugs" which are used to isolate selected zones in cased well bores for the purposes of well completion or recompletion, and, in particular, to an anchoring extrusion limiter for non-retrievable packers, and a composite frac plug incorporating same.

BACKGROUND OF THE INVENTION

Packers for isolating fluid pressures in cased well bores are well known in the art. Many such packers are single-use packers that are not retrievable from the well bore. One example of a single-use packer is the frac plug, used to isolate fracturing fluid pressure during hydrocarbon well completion or recompletion operations. Once a frac plug is set it can only be removed from the well bore by drilling out the frac plug using a drill bit on a tubing work string. The drill-out operation is facilitated by providing a frac plug made entirely of composite materials. Once such frac plug is described in Applicant's co-pending U.S. patent application Ser. No. 15/935,163 entitled Composite Frac Plug which was filed on Mar. 26, 2018, the entire specification of which is incorporated herein by reference. Frac plugs must contain extreme fluid pressures within cased well bores, generally at elevated temperatures. The fluid pressure can cause the main sealing element of frac plugs to extrude and lose their fluid sealing contact with the well bore casing. Anti-extrusion inhibitors help control sealing element extrusion and maintain the sealing element in sealing contact with the well bore casing. Anti-extrusion rings are one type of anti-extrusion inhibitor that has proven to be effective in inhibiting sealing element extrusion. However anti-extrusion rings can be deformed or displaced by an extruding main sealing element. An anchoring extrusion limiter that engages the casing to resist main sealing element extrusion pressure is therefore desirable.

Extreme fluid pressures also tend to displace the frac plug within the cased well bore. The frac plug is provided with "slips" that bite and grip the casing to anchor the frac plug within the well bore. The slips ride up a slip ramp to a set condition, so the greater the fluid pressure on the frac plug, the more the slips bite and grip the casing to anchor the frac plug in the well bore. However, the thrust load on the slips may exceed a material strength of the slip bodies or anchor elements. A backup anchor to the frac plug slips is therefore also desirable.

There therefore exists a need for an anchoring extrusion limiter and a frac plug incorporating same.

SUMMARY OF THE INVENTION

It is therefore an object of the invention to provide an anchoring extrusion limiter and a composite frac plug incorporating same.

The invention therefore provides a anchoring extrusion limiter for a main sealing, element of a non-retrievable packer, comprising a plurality of ring segments held together by at least one fracture band that is designed to fracture when the anchoring extrusion limiter is expanded as the non-retrievable packer is shifted from a run-in condition to a set condition, each ring segment having a top surface with least one embedded ring segment insert adapted to bite and grip a well casing in which the non-retrievable packer is set.

The invention further provides a anchoring extrusion limiter for a main sealing element of a non-retrievable packer comprising a plurality of ring segments respectively being substantially V-shaped in cross-section and at least one ring segment insert adapted to bite and grip a well casing embedded in a top surface thereof, the respective ring segments being held together by a pair of fracture bands that are received in respective ring segment grooves respectively located on opposite sides of the respective ring segment inserts, the respective fracture bands being adapted to fracture when the anchoring extrusion limiter is expanded as the non-retrievable packer is shifted from a run-in condition to a set condition.

The invention yet further provides a composite frac plug, comprising: a composite mandrel with a central passage, the composite mandrel further having an up-hole end and a downhole end with a mandrel hub on the up-hole end, and an end sub securely affixed to the downhole end; an elastomeric gripper assembly mounted to the mandrel, the elastomeric gripper assembly having an insert groove with a plurality of circumferentially spaced-apart inserts that bite and grip a casing of a cased wellbore when the composite frac plug is in, a set condition; a main sealing element downhole of the elastomeric gripper assembly; a sliding cone downhole of the main sealing element; an anchoring extrusion limiter downhole of the main sealing element, the anchoring extrusion limiter comprising a plurality of ring segments held together by at least one fracture band that fractures when the anchoring extrusion limiter is expanded as the composite frac plug is shifted from a run-in condition to the set condition, each ring segment having a top surface with at least one embedded ring segment insert adapted to bite and grip a well casing in which the composite frac plug is set, to inhibit downhole movement of the anchoring extrusion limiter and the composite frag plug after the composite frac plug has been shifted to the set condition; a slip hub downhole of the anchoring anti-extrusion limiter; and a slip assembly downhole of the slip hub, the slip assembly comprising a plurality of slips adapted to slide up the slip cone to bite and grip the casing of the cased wellbore when the composite frac plug is shifted from the run-in condition to the set condition.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a novel anchoring extrusion limiter and a composite frac plug incorporating same. The anchoring extrusion limiter inhibits an extrusion of a main sealing element of the composite frac plug. The anchoring extrusion limiter is constructed from a plurality of identical ring segments. Each ring segment has a top surface that is provided with at least one ring segment insert adapted to bite and grip a well casing when the composite frac plug is shifted from a "run-in" to a "set" condition. This ensures that the anchoring extrusion limiter is very strongly inhibited from displacement in the cased well bore by frac fluid pressure contained by a main sealing element of the composite frac plug. The anchoring extrusion limiter is very effective in inhibiting packer element extrusion under high temperature and fluid pressure conditions, while providing back-up anchoring in a cased well bore to the anchoring slips of the frac plug. The ring segments are readily constructed from rigid plastic, or composite material using injection molding, casting, composite tape laying or 3-D printing techniques well known in the art. In one embodiment, the ring segment inserts are ceramic cylinders. In one embodiment, the ring segments are held together by a pair of pre-scored fracture bands that are adapted to fracture as the anchoring extrusion limiter is expanded, from the run-in to the packer-set condition.

PARTS LIST

| Part No. | Part Description |
|---|---|
| 10 | Anchoring extrusion limiter |
| 12 | Ring segments |
| 14 | Ring segment inner surface |
| 16 | Ring segment top surface |
| 18 | Ring segment side surface |
| 20 | Ring segment inserts |
| 22 | Fracture bands |
| 24 | Fracture band grooves |
| 26 | Fracture band scores |
| 30 | Composite frac plug |
| 32 | Composite mandrel |
| 34 | Composite mandrel hub |
| 36 | Composite mandrel passage |
| 38 | Shear screw bores |
| 40 | Gauge load ring |
| 42 | Gauge load ring retainer pins |
| 44 | Elastorneric gripper assembly |
| 46 | Elastomeric gripper assembly groove |
| 48 | Ceramic inserts |
| 50 | Main sealing element |
| 51 | Sliding cone |
| 52 | Slip hub |
| 54 | Slip cone |
| 56 | Anti-extrusion cone |
| 58 | Slip hub retainer pins |
| 60 | Slip assembly |
| 62 | Slip retainer bands |
| 64 | Composite slips |
| 66 | Ceramic slip inserts |
| 68 | Lower end sub |
| 70 | Lower end sub retainer pins |

-continued

PARTS LIST

| Part No. | Part Description |
|---|---|
| 72 | Frac ball |
| 74 | Well casing |

Figure 1:
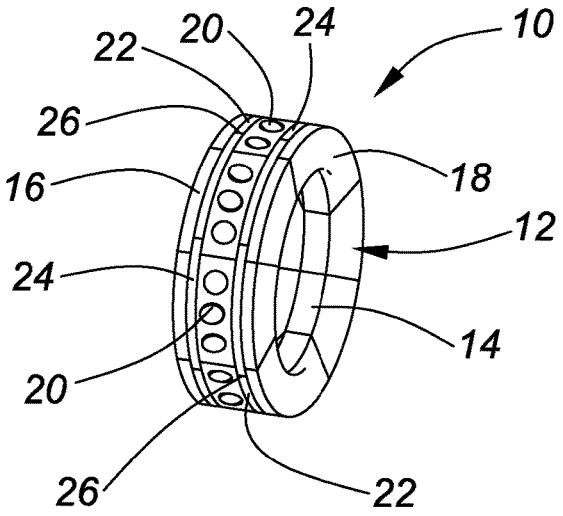
FIG. 1 is a perspective view of one embodiment of an anchoring extrusion limiter accordance with the invention, in an unexpended or "run-in" condition.

FIG. 1 is a perspective view of an embodiment of an anchoring extrusion limiter 10 in accordance with the invention, in an unexpanded or the run-in condition. The anchoring extrusion limiter 10 is constructed using a plurality of identical ring segments 12 that are substantially V-shaped in cross-section (see FIG. 4). Each ring segment 12 has an inner surface 14, a top surface 16 and side surfaces 18. In one embodiment, mating ring segment end faces are radially-flat surfaces. However, it should be understood that this is a matter of design choice and the mating ring segment end faces can be 2-dimensionally curved surfaces, or 3-dimensionally curved surfaces as described in Applicant's co-pending U.S. patent application Ser. No. 16/561,385 entitled Single-Set Anti-Extrusion Ring with 3-Dimensionally Curved Mating Ring Segment Faces filed Sep. 5, 2019, the entire specification of which is incorporated herein by reference.

Each ring segment 12 also has at least one ring segment insert 20 embedded in a top surface 16 thereof. In one embodiment, each ring segment 12 includes three equally-spaced ring segment inserts 20 and the ring segment inserts 20 are ceramic cylinders, though this is also a matter of design choice. Any other fracture-resistant and abrasion-resistant material that is harder than well casing, such as a steel alloy, a carbide or the like, may also be used for the ring segment inserts 20. Each ring segment insert 20 is embedded in the top surface 16 at an angle offset from a radius of the anchoring extrusion limiter 10 so that an edge of each ring segment insert 20 adjacent one side of the of the anchoring, extrusion limiter 10 projects above the top surface 16 (see FIG. 4). When a non retrievable packer is assembled using the anchoring extrusion limiter 10, the edge of the anchoring extrusion limiter 10 with the projecting ring segment inserts 20 is oriented to be opposite a main sealing element of the non-retrievable packer (see FIGS. 4 and 8), so that the respective ring segment inserts 20 will bite and grip the well casing to inhibit movement of the ring segments 12 after the anchoring extrusion limiter 10 is shifted from the run-in condition to the set condition.

In one embodiment, the respective ring segments 12 are bound together in the run-in condition by a pair of fracture bands 22. In one embodiment, each fracture band 22 is a rigid ring that is substantially square in cross-section and has a plurality of spaced-apart fracture band scores 26. The respective fracture bands 22 are received in respective fracture band grooves 24 located on opposite sides of the ring segment inserts 20. The fracture band scores 26 provide weakened areas in the fracture bands 22 to promote breakage of the respective fracture bands 22 when the anchoring extrusion limiter 10 is shifted from the run-in to the packer-set condition to permit the anchoring extrusion ring 10 to expand outwardly into contact with a well casing, as will be explained below.

Figure 1A:
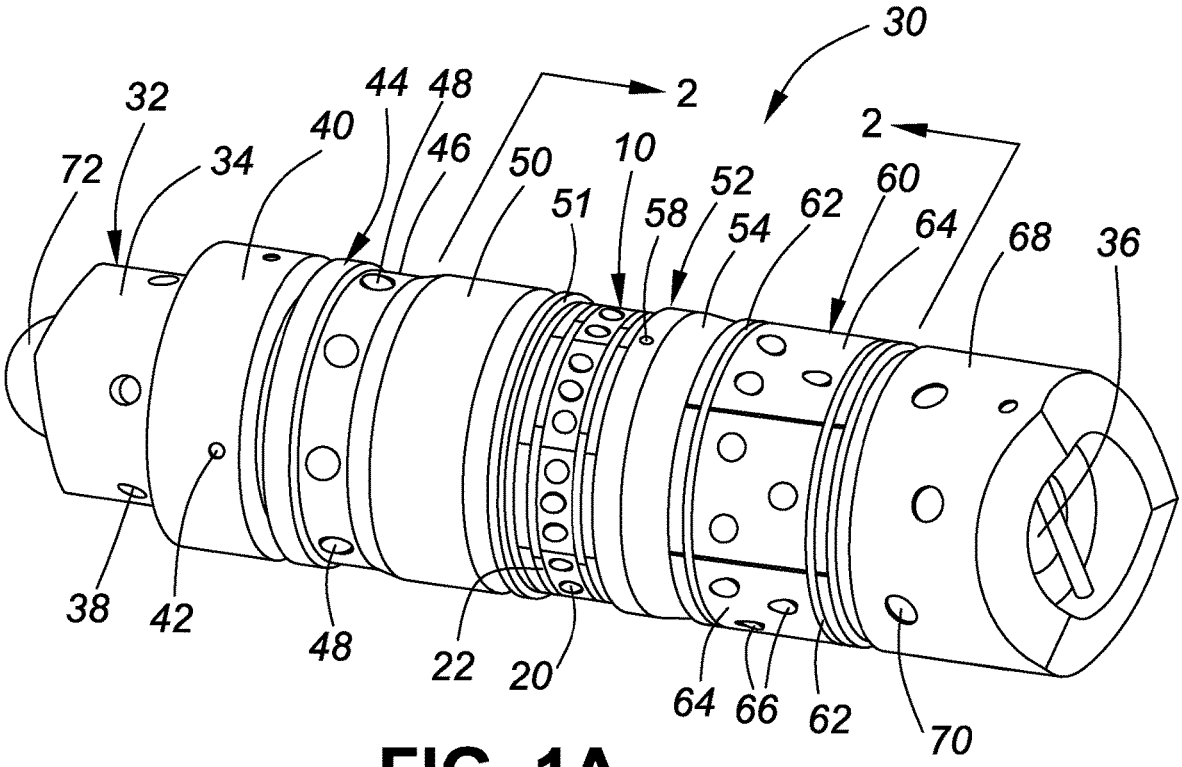
FIG. 1A is a perspective view of a composite frac plug incorporating the anchoring extrusion limiter shown in FIG. 1.

FIG. 1A is a perspective view of a composite frac plug 30 equipped with the anchoring extrusion limiter 10 shown in FIG. 1, in the run-in condition. The composite frac plug 30 is one embodiment of composite frac plugs and a method of setting same described in detail in Applicant's co-pending U.S. patent application Ser. No. 15/935,163 entitled Composite Frac Plug, which was filed on Mar. 26, 2018, the entire specification of which is incorporated herein by reference.

The composite frac plug 30 has a composite mandrel 32 with a composite mandrel hub 34. A composite mandrel passage 36 provides fluid communication through an entire length of the composite mandrel 32. Shear screw bores 38 in the composite mandrel hub 34 receive shear screws (not shown) that connect the composite frac plug 30 to a frac plug setting sleeve (not shown) that is, in turn connected to a surface-located wireline setting tool (a Baker style size 20, for example, not shown) used to set the composite frac plug 30 in a cased well bore in a manner well known in the art and explained in detail in Applicant's above-referenced co-pending, patent application. A gauge load ring 40 downhole of the composite mandrel hub 34 is connected to the composite mandrel 32 by gauge load ring preset retainer pins 42. The gauge load ring preset retainer pins 42 secure the gauge load ring 40 in the run-in position shown in FIG. 6 until the composite frac plug 30 is pumped down to a desired location in a wellbore. The gauge load ring preset retainer pins 42 shear when the composite frac plug 30 is shifted from the run-in condition to a packer set condition, as explained in Applicant's co-pending patent application referenced above, Downhole of the gauge load ring 40 is an elastomeric gripper assembly 44 with a circumferential elastomeric gripper assembly groove 46. Circumferentially distributed in the elastomeric gripper assembly groove 46 are a plurality of ceramic inserts 48 designed to bite and grip a well casing when the composite frac plug 30 is moved to the set condition shown in FIG. 5. In the run-in condition shown FIG. 1A, the ceramic inserts 48 are recessed within the elastomeric gripper assembly groove 46 and do not contact a casing of a cased well bore.

Adjacent a downhole side of the elastomeric gripper assembly 44 is an elastomeric main sealing element 50. The main sealing element 50 provides a high-pressure seal against a well casing 74 (see FIGS. 3 and 4) when the composite frac plug 30 is in the set condition (see FIGS. 5-8). Adjacent a downhole side of the main sealing element 50 is a sliding cone 51, the structure and function of which will be described below with reference to FIG. 4. Adjacent a downhole side of the sliding cone 51 is the anchoring extrusion limiter 10, described in detail above. The anchoring extrusion limiter 10 inhibits extrusion of the main sealing element 50 when the composite frac plug 30 is in the set condition and subjected to high fluid pressures, and helps anchor the composite frac plug 30 in a cased well bore when the composite frac plug 30 is in the set condition, as will be explained below with reference to FIGS. 5-8. Adjacent a downhole side of the anchoring extrusion limiter 10 is a slip hub 52. The slip hub 52 is secured to the composite mandrel 32 by slip hub retainer pins 58, which shear when the composite frac plug 30 is shifted from the run-in condition to the set condition. The slip hub 52 provides a slip cone 54 for a slip assembly 60 that, in one embodiment, is a frangible slip assembly that includes six composite slips 64 that are bound together by slip retainer bands 62 while the frac plug 30 is in the run-in condition. In one embodiment each composite slip 64 includes three ceramic slip inserts 66. Adjacent a lower end of the slip assembly 60 is a lower end sub 68. The lower end sub 68 is secured to the lower end of the composite mandrel 32 by lower end sub retainer pins 70 arranged in two staggered rows. A frac ball 72 inhibits fluid flow through the composite mandrel passage 36 of the composite mandrel 32 while the composite frac plug 30 is being pumped down a cased well bore and while the composite frac plug is pressure isolating a well bore zone being stimulated using fracturing fluid, for example.

Figure 2:
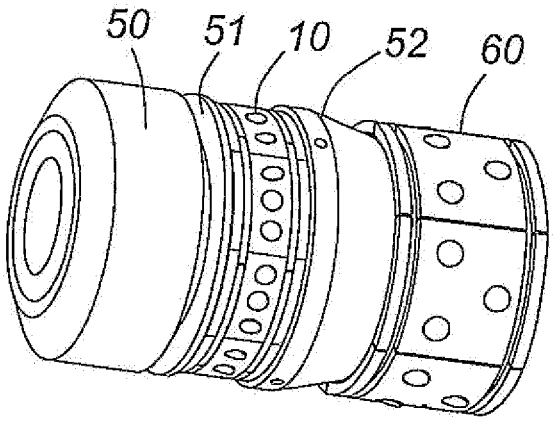
FIG. 2 is a perspective view from the left of section 2-2 of the composite frac plug shown in FIG. 1A.

FIG. 2 is a perspective view from the left of section 2-2 of the composite frac plug 30 shown in FIG. 1A. As explained above, a downhole side of the main sealing element 50 abuts the sliding cone 51, which supports an uphole side of the anchoring extrusion limiter 10. A downhole side of the anchoring extrusion limiter 10 is supported by an uphole end of the slip hub 52, as better seen in FIG. 4. The slip assembly 60 is carried on a downhole end of the slip hub 52 when the composite frac plug 30 is in the run-in condition.

Figure 3:
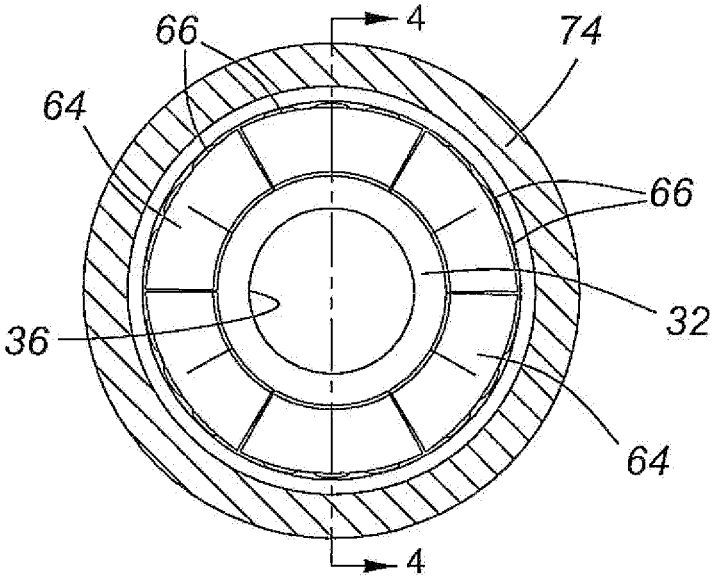
FIG. 3 is a right end elevational view of the section 2-2 of the composite frac plug shown in FIG. 2, within a well casing.

FIG. 3 is a right end elevational view of the section 2-2 of the composite frac plug 30 shown in FIG. 2, within a well casing 74. As can be seen, in the run-in condition of the composite frac plug 30, the ceramic slip inserts 66 of the respective composite slips 64 do not bite or grip the well casing 74, nor do the ring segment inserts 20 of the anchoring extrusion limiter 10, as will be explained below.

Figure 4:
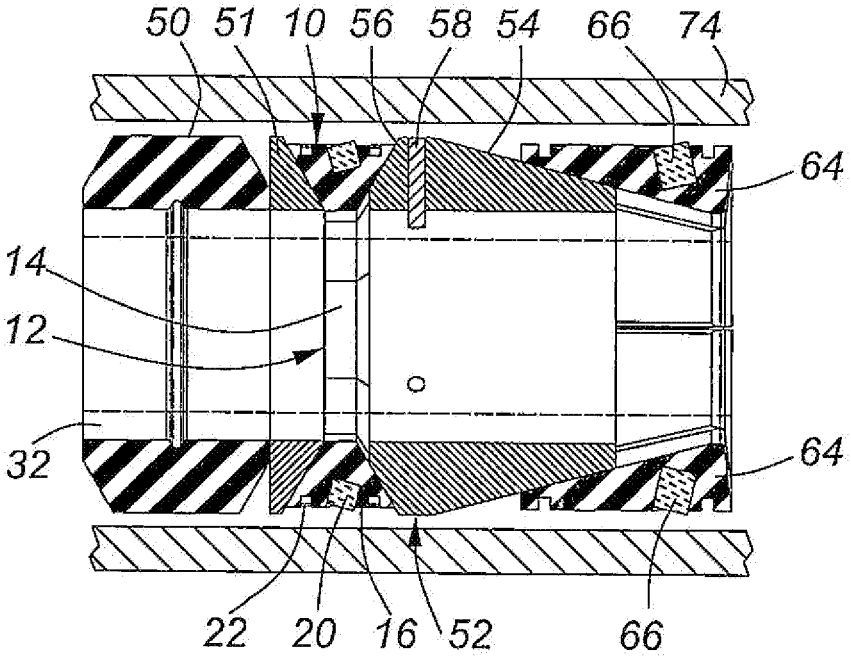
FIG. 4 is a cross-sectional view of the section 2-2 of the composite frac plug taken along lines 4-4 of FIG. 3.

FIG. 4 is a cross-sectional view of the section 2-2 of the composite frac, plug 30 taken along lines 4-4 of FIG. 3. As explained above, the anchoring extrusion limiter 10 is supported on the uphole side by the sliding cone 51 and on the downhole side by an anti-extrusion cone 56 on an uphole end of the slip hub 52. In the run-in condition the ring segment inner surfaces 14 of each ring segment 12 rest against the composite mandrel 32, which is shown in dashed lines for purposes of illustration. As can be further seen, in the run-in condition, the projecting edge of each ring segment insert 20 is on a side of the respective ring segments 12 opposite the main sealing element 50 and spaced below respective top edges of the sliding cone 51 and the anti-extrusion cone 56.

Figure 5:
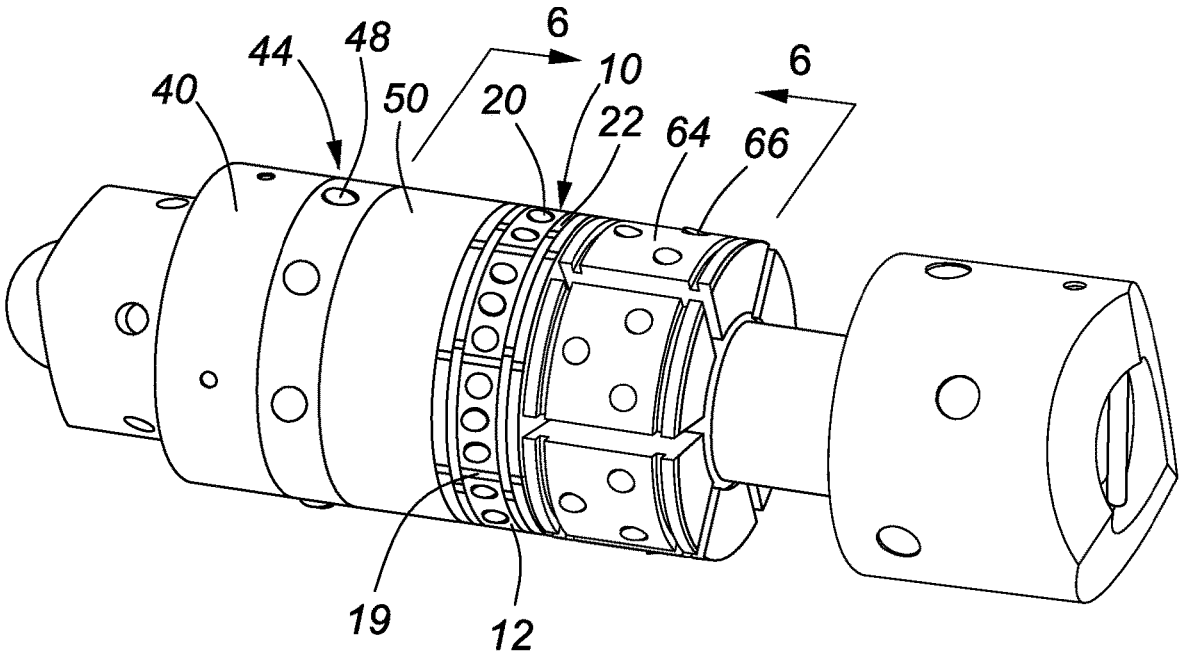
FIG. 5 is a perspective view of the composite frac plug shown in FIG. 1A in a set condition.
Figure 8:
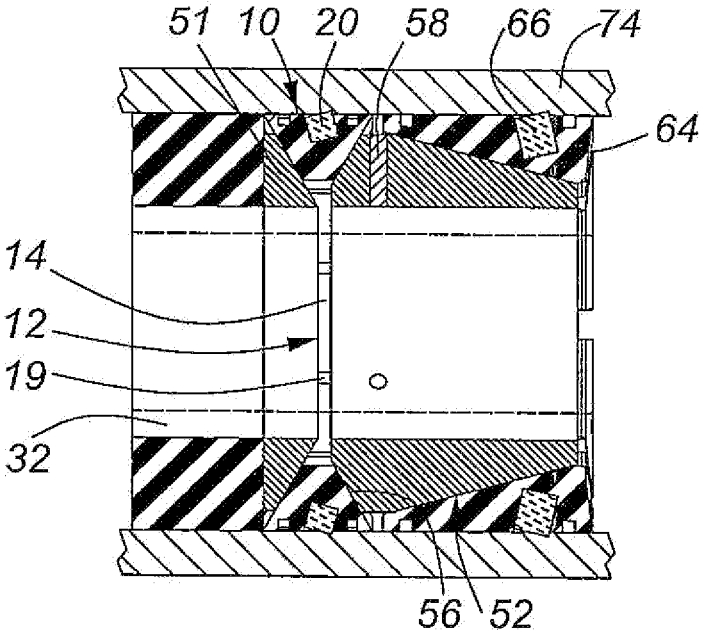
FIG. 8 is a cross-sectional view of the section 6-6 of the composite frac plug taken along lines 8-8 of FIG. 7.

FIG. 5 is a perspective view of the composite frac plug 30 shown in FIG. 1A in a set condition. As can be seen, in the set condition, the elastomeric gripper assembly 44 is compressed to an extent that the ceramic inserts 48 are forced upwardly out of the elastomeric, gripper assembly groove 46 (see FIG. 1A) into biting and gripping contact with the casing, as explained in Applicant's co-pending application Ser. No. 15/935,163 referenced above and shown in FIG. 8. The main sealing element 50 is compressed and forced outwardly into high-pressure sealing contact with the well casing 74 (see FIG. 8), and the anchoring extrusion limiter 10 is expanded to an extent that the respective fracture bands 22 have broken at one or more of the fracture band scores 26, and the mating faces 19 of the respective ring segments 12 have separated, moving the ring segment inserts 20 into biting and gripping contact with the well casing 74, as also shown in FIG. 8. As well, the respective composite slips 64 have been forced up the slip cone 54 of the slip hub 52 and the ceramic slip inserts 66 are forced into biting and gripping contact with the well casing 74 (see FIG. 8). As understood by those skilled in the art, in the set condition, the elastomeric gripper assembly 44 holds the main sealing element in the set condition, i.e. in high-pressure sealing contact with the well casing 74. Whereas, the composite frac plug 30 must be held in the set location in the well casing 74 against frac fluid pressure, which can exceed 15,000 pounds per square inch (psi). Without the anchoring extrusion limiter 10, all of the fluid pressure load must be borne by the composite slips 64. However, with the anchoring extrusion limiter 10, not only is extrusion of the main sealing element 50 resisted by the casing biting and gripping anchor of the anchoring extrusion limiter 10, the fluid pressure load on the composite frac plug 30 is shared by the anchoring extrusion limiter 10 and the composite slips 64, ensuring that the composite frac plug 30 can contain very high fluid pressures within the well casing 74 without being displaced.

Figure 6:
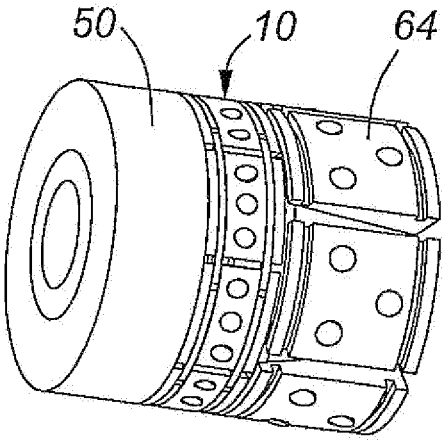
FIG. 6 is a perspective view of section 6-6 of the composite frac plug shown in FIG. 5.

FIG. 6 is a perspective view of section 6-6 of the composite frac plug 30 shown in FIG. 5 in the packer-set condition. As can be seen, the main sealing element has expanded above a top of the sliding cone 51 and contacts the anchoring ant-extrusion limiter 10, which has expanded into tight contact with the well casing 74 (see FIG. 8) to inhibit extrusion of the main sealing element in response to frac fluid pressure in the well casing 74.

Figure 7:
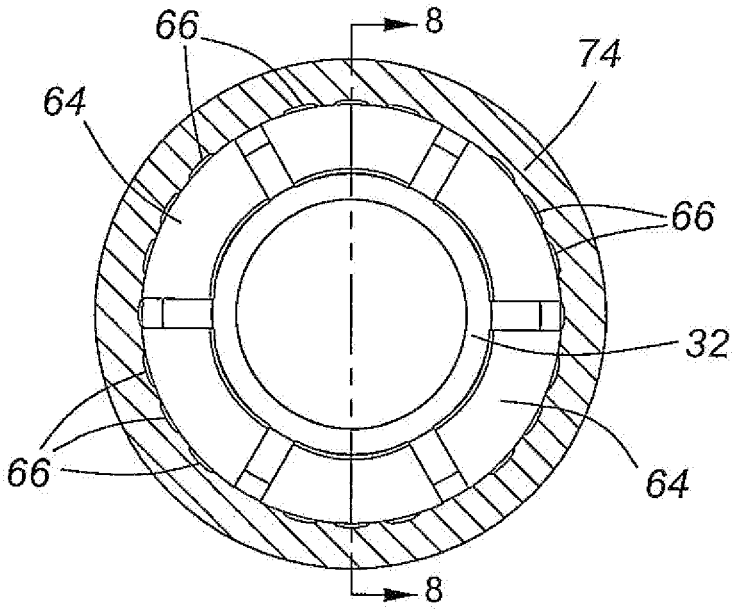
FIG. 7 is a right end elevational view of the section 6-6 of the composite frac plug shown in FIG. 6, within the well casing.

FIG. 7 is a right end elevational view of the section 6-6 of the composite frac plug 30 shown in FIG. 6, within the well casing 74. As explained above, in the packer-set condition the respective ceramic slip inserts 66 bite and grip the well casing 74 to anchor the composite frac plug 30 in the set location within the well casing 74.

FIG. 8 is a cross-sectional view taken along lines 8-8 of FIG. 7. As can be seen, in the packer-set condition the sliding cone 51 has been pushed down the mandrel 32 by the compressed main sealing element 50, forcing the ring segments 12 of the anchoring anti-extrusion ring 10 against the anti-extrusion cone 56 of the slip hub 52 and upwardly, fracturing the respective fracture bands 22 and urging the ring segments 12 into tight contact with the well casing 74. When the respective ring segments 12 contact the well casing 74, the ring segment inserts 20 bite and grip the well casing 74 to anchor the respective ring segments 12 of the anchoring extrusion inhibitor 10, and to back up the anchoring bite of the ceramic slip inserts 66 of the composite slips 64.

The explicit embodiments of the invention described above have been presented by way of example only. Other embodiments of the anchoring extrusion limiter are readily constructed with minor alterations, as will be understood by those skilled in the art. As well, the anchoring extrusion limiter has been described with reference to a composite frac plug, but may be used to limit the extrusion of a main sealing element of any non-retrievable downhole packer of a compatible type. The scope of the invention is therefore intended to be limited solely by the scope of the appended claims.

I claim:

1. A composite frac plug, comprising:

a composite mandrel with a central passage, the composite mandrel further having an up-hole end and a downhole end with a mandrel hub on the up-hole end, and an end sub securely affixed to the downhole end;

an elastomeric gripper assembly mounted to the mandrel, the elastomeric gripper assembly having an, insert groove with a plurality of circumferentially spaced-apart inserts that bite and grip a casing of a cased wellbore when the composite frac plug is in a set condition;

a main sealing element downhole of the elastomeric gripper assembly;

a sliding cone downhole of the main sealing element;

an anchoring extrusion limiter downhole of the main sealing element, the anchoring extrusion limiter comprising a plurality of ring segments held together by at least one fracture band that fractures when the anchoring extrusion limiter is expanded as the composite frac plug is shifted from a run-in condition to the set condition, each ring segment having a top surface with at least one embedded ring segment insert adapted to bite and grip a well casing in which the composite frac plug is set, to inhibit downhole movement of the anchoring extrusion limiter and the composite frag plug after the composite frac plug has been shifted to the set condition;

a slip hub downhole of the anchoring anti-extrusion limiter; and a slip assembly downhole of the slip hub, the slip assembly comprising a plurality of slips adapted to slide up the slip cone to bite and grip the casing of the cased wellbore when the composite frac plug is shifted from the run-in condition to the set condition.

2. The composite frac plug as claimed in claim 1 wherein the embedded ring segment inserts in the anchoring extrusion limiter comprise ceramic inserts set at an angle with respect to a radius of the anchoring extrusion limiter so that each embedded ring segment insert has an edge that projects above a top surface adjacent one side of the anchoring extrusion limiter.

3. The composite frac plug as claimed in claim 1 wherein the at least one fracture band comprises a rigid ring that is substantially square in cross-section and has a plurality of spaced-apart fracture band scores.

4. The composite frac plug as claimed in claim 3 wherein the respective ring segments comprise a fracture band groove in the top surface thereof, on respective sides of the at least one embedded ring segment insert, and each fracture band groove receives one of the at least one fracture band.

5. The composite frac plug as claimed in claim 1 wherein the sliding cone is adapted to slide over the composite mandrel, the sliding cone supporting an uphole side of the anchoring extrusion limiter.

6. The composite frac plug as claimed in claim 1 wherein an uphole end of the slip hub comprises an anti-extrusion cone that supports a downhole side of the anchoring extrusion limiter.

7. The composite frac plug as claimed in claim 1 wherein the interconnected slips are bound together on the composite mandrel by a binding that shears as the composite frac plug is shifted from the run-in condition to the set condition.

8. The composite frac plug as claimed in claim 1 wherein the slips comprise composite slips with ceramic slip inserts that bite and grip the casing of the cased wellbore when the composite frac plug is shifted from the run-in condition to the set condition to resist downhole movement of the composite frac plug in the set condition.

9. The composite frac plug as claimed in claim 1 wherein the inserts in the elastomeric gripper assembly comprise ceramic inserts.

10. A composite frac plug, comprising:

a composite mandrel with a composite mandrel passage, the composite mandrel having an up-hole end and a downhole end with a mandrel hub on the up-hole end and an end sub affixed to the downhole end;

an elastomeric gripper assembly mounted to the composite mandrel, the elastomeric gripper assembly having an insert groove with a plurality of circumferentially spaced-apart inserts that bite and grip a casing of a cased wellbore when the composite frac plug is in a set condition;

a main sealing element downhole of the elastomeric gripper assembly;

an anchoring extrusion limiter downhole of the main sealing element, the anchoring extrusion limiter comprising a plurality of ring segments held together by a pair of fracture bands that fracture when the anchoring extrusion limiter is expanded as the composite frac plug is shifted from a run-in condition to the set condition, each ring segment having a top surface with at least one embedded ring segment insert adapted to bite and grip a well casing in which the composite frac plug is set, to inhibit downhole movement of the anchoring extrusion limiter after the composite frac plug has been shifted to the set condition;

a slip hub downhole of the anchoring anti-extrusion limiter; and a slip assembly downhole of the slip hub.

11. The composite frac plug as claimed in claim 10 wherein the embedded ring segment inserts in the anchoring extrusion limiter comprise ceramic inserts having an edge that projects above a top surface of the anchoring extrusion limiter.

12. The composite frac plug as claimed in claim 10 wherein the pair of fracture bands comprise rigid rings that are substantially square in cross-section and have a plurality of spaced-apart fracture band scores.

13. The composite frac plug as claimed in claim 12 wherein the respective ring segments comprise a pair of spaced-apart fracture band grooves in the top surface thereof, and each of the fracture band grooves receives one of the fracture bands.

14. The composite frac plug as claimed in claim 10 further comprising a sliding cone adapted to slide over the composite mandrel, the sliding cone being on a downhole side of the main sealing element and supporting an uphole side of the anchoring extrusion limiter.

15. The composite frac plug as claimed in claim 14 wherein an uphole end of the slip hub comprises an anti-extrusion cone that supports a downhole side of the anchoring extrusion limiter.

16. The composite frac plug as claimed in claim 10 wherein the slip assembly comprises a plurality of interconnected slips, the interconnected slips being bound together on the composite mandrel by a slip binding that shears as the composite frac plug is shifted from the run-in condition to the set condition.

17. The composite frac plug as claimed in claim 16 wherein the slips comprise composite slips with ceramic slip inserts that bite and grip the casing of the cased wellbore when the composite frac plug is shifted from the run-in condition to the set condition.

18. The composite frac plug as claimed in claim 10 wherein the inserts in the electromeric gripper assembly comprise ceramic cylinders.

* * * * *